US007679018B2

(12) United States Patent
Kolmonen et al.

(10) Patent No.: US 7,679,018 B2
(45) Date of Patent: Mar. 16, 2010

(54) SWITCHING DEVICE

(75) Inventors: Rainer Kolmonen, Laihia (FI); Aki Suutarinen, Vaasa (FI); Jarkko Alanen, Yilhärmä (FI); Harri Mattlar, Iskmo (FI)

(73) Assignee: ABB Oy, Helsinki (FI)

( * ) Notice: Subject to any disclaimer, the term of this patent is extended or adjusted under 35 U.S.C. 154(b) by 644 days.

(21) Appl. No.: 10/586,521

(22) PCT Filed: Jan. 18, 2005

(86) PCT No.: PCT/FI2005/000031

§ 371 (c)(1),
(2), (4) Date: Apr. 10, 2007

(87) PCT Pub. No.: WO2005/069323

PCT Pub. Date: Jul. 28, 2005

(65) Prior Publication Data

US 2008/0035464 A1 Feb. 14, 2008

(30) Foreign Application Priority Data

Jan. 19, 2004 (FI) ..... 20040067

(51) Int. Cl.
*H01H 3/40* (2006.01)

(52) U.S. Cl. ..... 200/564; 200/500; 200/501

(58) Field of Classification Search ..... 200/17 R, 200/6 R, 6 B, 6 BA, 19.01, 19.03, 19.04, 200/19.05, 19.07, 19.13, 19.18, 19.2, 36, 200/38 R, 33 B, 564, 568, 569, 307, 329, 200/336, 334, 500, 501, 6 C
See application file for complete search history.

(56) References Cited

U.S. PATENT DOCUMENTS

| | | | | |
|---|---|---|---|---|
| 3,260,803 | A * | 7/1966 | Moroishi | 200/6 B |
| 3,300,595 | A * | 1/1967 | Holzer | 200/19.01 |
| 4,218,594 | A | 8/1980 | Komatsu et al. | |
| 4,918,272 | A * | 4/1990 | Nishikawa | 200/501 |
| 5,777,283 | A | 7/1998 | Greer | |
| 6,317,019 | B1 | 11/2001 | Herpin et al. | |
| 7,094,982 | B2 * | 8/2006 | Liu | 200/336 |

FOREIGN PATENT DOCUMENTS

| | | |
|---|---|---|
| JP | 09-050740 | 2/1997 |
| JP | 2000-243189 | 9/2000 |

* cited by examiner

*Primary Examiner*—Michael A Friedhofer
(74) *Attorney, Agent, or Firm*—Buchanan Ingersoll & Rooney PC

(57) ABSTRACT

A switching device is disclosed which includes a working shaft and a control shaft installed in a frame part, the control shaft being rotatable and adapted to turn the working shaft, and the working shaft being adapted to change the position of poles of the switching device. One of the two shafts passes through the other.

11 Claims, 2 Drawing Sheets

SWITCHING DEVICE

The present application claims priority under 35 USC §119 to Finnish Patent Application Number 20040067, filed Jan. 19, 2004, the disclosure of which is hereby incorporated by reference in its entirety.

BACKGROUND OF THE INVENTION

The invention relates to switching devices according to the preamble of claim 1.

Switching devices are instruments employed for opening and closing an electric circuit. The switching device comprises at least one pole and a control device adapted to open and close said pole. Switching devices include switches and switch-fuses, for example.

A switching device of a known type comprises a control shaft and a working shaft installed in a frame part, the control shaft being rotatable and adapted to turn the working shaft, which, in turn, is adapted to change the position of the poles of the switching device. The control shaft of such a switching device is typically substantially transverse relative to the working shaft.

The problem in the above-described arrangement is that limiter means have to be provided in the frame part of the switching device for limiting the rotational angle of the control shaft and/or the working shaft.

BRIEF DESCRIPTION OF THE INVENTION

The object of the invention is to provide a switching device allowing the above-mentioned problems to be solved. The object of the invention is achieved with a switching device, which is characterized in what is stated in the independent claims. Preferred embodiments of the invention are described in the dependent claims.

The invention is based on designing and placing the working shaft and the control shaft of a switching device such that one of them passes through the other.

An advantage of the switching device of the invention is that no separate limiter means for limiting the rotational angle of the control shaft or the working shaft have to be provided in the frame part. In addition, in certain kind of assemblies, the structure of the switching device of the invention is advantageous as regards the use of space. Furthermore, in certain cases, the invention simplifies the structure of the switching device assembly.

BRIEF DESCRIPTION OF THE FIGURES

In the following, the invention will be described in more detail in connection with preferred embodiments with reference to the accompanying drawings, in which.

DETAILED DESCRIPTION OF THE INVENTION

Figure 1:
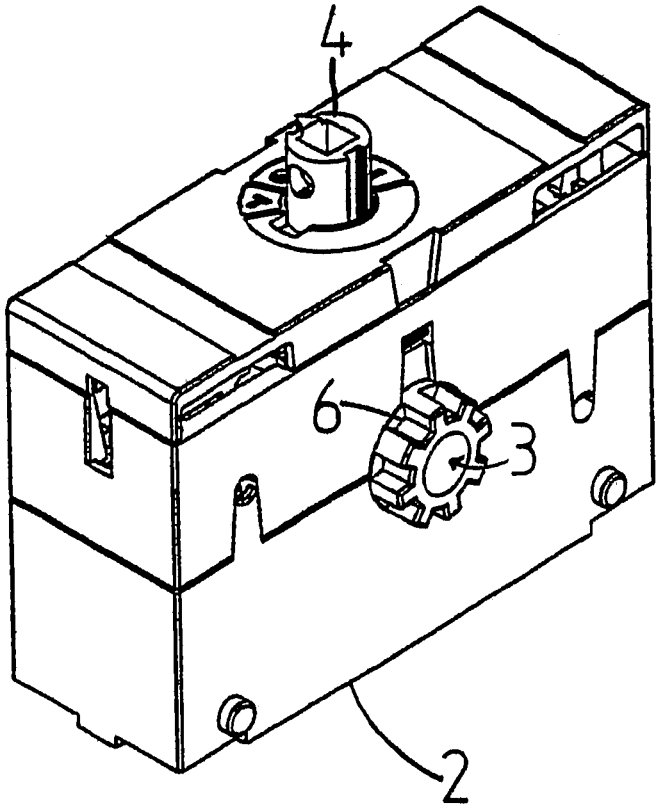
FIG. 1 shows the control device module of a switching device according to an embodiment of the invention seen obliquely from above.
Figure 2:
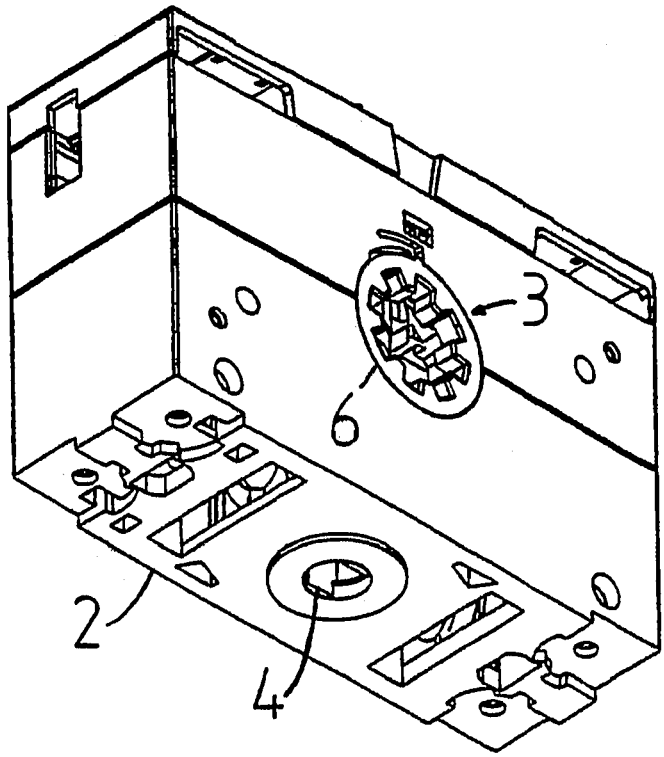
FIG. 2 shows the control device module of FIG. 1 seen obliquely from below.

A switching device according to an embodiment of the invention is composed of a control device module and pole cell modules (not shown) connected thereto according to FIG. 1. A working shaft 3 and a control shaft 4 are installed in a frame part 2 of the control device module, the control shaft being rotatable and adapted to turn the working shaft, and the working shaft 3 being adapted to change the position of the poles of the switching device. A shaft element 6 in the control device module constitutes part of the working shaft 3 of the switching device. FIG. 2 shows that the control shaft 4 extends substantially through the frame 2 of the control device module, and that the control shaft 4 can also be accessed from the bottom of the frame 2 of the control device module.

Figure 3A:
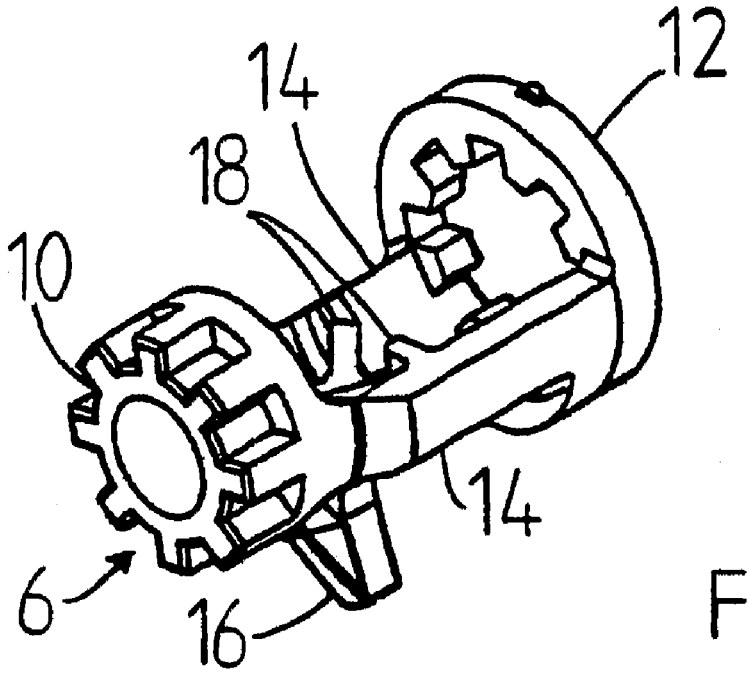
FIG. 3*a* shows a shaft element of the control device module of FIG. 1.

FIG. 3*a* shows a shaft element 6 detached from the control device module of FIG. 1. The shaft element 6 comprises a first end 10, a second end 12 and two crossbars 14 interconnecting said first and second end. A gap remains between the crossbars 14 and it passes via the axis of revolution of the shaft element 6. The crossbars 14 are shaped and placed such that, seen from the axial direction, the distance between the crossbars 14 is about 180° on the first side, and about 90° on the other side.

The second end 12 of the shaft element 6 is thicker than the first end 10. The crossbars 14 are connected substantially to the periphery of the first 10 and second 12 ends. On the larger part of the stretch between the ends 10 and 12 of the shaft element 6 the distance between the crossbars 14 substantially corresponds to the diameter of the second end 12 of the shaft element 6. The bends of the crossbars 14, intended to change the distance between the crossbars to correspond substantially to the diameter of the first end 10 of the shaft element 6, are provided adjacent to the first end 10.

The shaft element 6 is adapted such that it is able to transfer the power required for opening and closing the poles of the switching device in the direction of both its first end 10 and its second end 12. Accordingly, pole cell modules can be installed in the first end 10 and/or the second end 12 of the shaft element 6.

The shaft element 6 is provided with a peg 16 adapted to turn the shaft element 6. The peg 16 is located adjacent to the first end 10 of the shaft element 6. The shaft element 6 is installed in the frame part 2 such that the peg 16 faces the lower part of the frame part 2.

Both crossbars 14 of the shaft element 6 are provided with a shoulder 18. The shoulders 18 are adapted to limit the turning of the control shaft 4. The first shoulder is adapted to limit the clockwise turning of the control shaft 4. This shoulder allows the control shaft to turn 90° clockwise relative to the basic position of the control shaft, whereby the control shaft is in a position corresponding to the I position of the switching device. The second shoulder is adapted to limit the anticlockwise turning of the control shaft 4. This shoulder allows the control shaft to turn 45° anticlockwise relative to the basic position of the control shaft, whereby the control shaft is in a position corresponding to the testing position of the switching device.

Figure 3B:
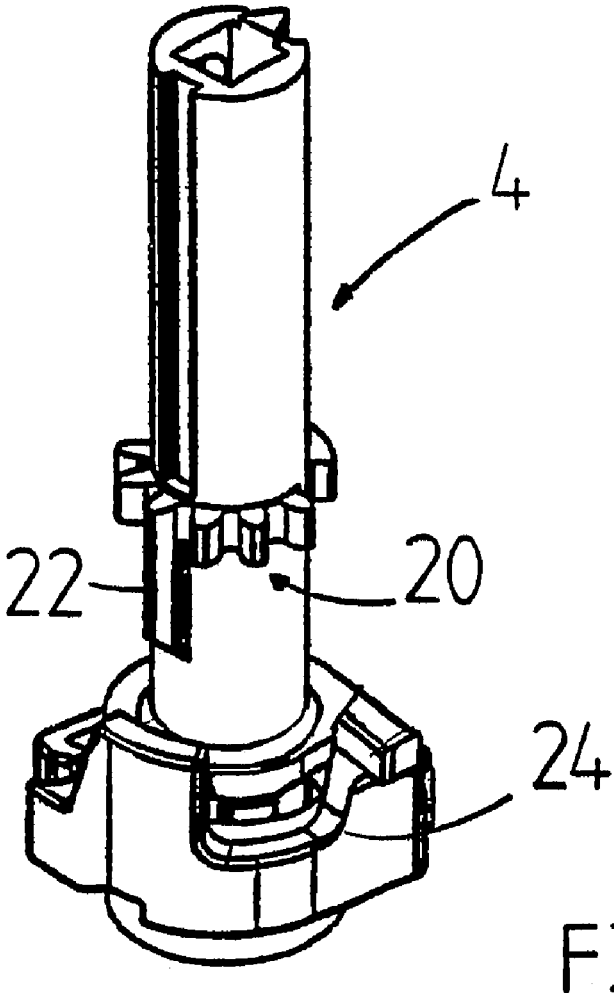
FIG. 3*b* shows a control shaft of the control device module of FIG. 1.

FIG. 3*b* shows a control shaft 4 detached from the control device module of FIG. 1. In the control device module of FIG. 1, the control shaft 4 passes between the crossbars 14 of the shaft element 6 through the shaft element such that the axes of rotation of the working shaft 3 and the control shaft 4 intercept at a substantially 90° angle.

In some alternative embodiments, the axes of rotation of the working shaft and the control shaft do not intercept, but, however, the working shaft and control shaft are at an angle relative to one another. Herein, shafts that are at an angle relative to one another refer to shafts that are not parallel.

Tooth means 20 are provided in the control shaft 4 and they are adapted to drive auxiliary contacts (not shown). The tooth means 20 also comprise a limiter tooth 22, which is adapted to cooperate with the shoulder 18 of the crossbar 14 for limiting the rotation of the control shaft 4. The limiter tooth 22 is longer in the axial direction of the control shaft 4 than the other teeth of the tooth means 20.

FIG. 3*b* also shows a cam element 24 installed in the lower end of the control shaft 4 and adapted to cooperate with the peg 16 of the shaft element for turning the shaft element 6.

The shaft element 6 is installed in the frame part 2 such that said smaller opening (about 90°) between the crossbars 14 faces the lower part of the frame part 2, said larger opening (about 180°) facing the upper part of the frame part 2. The smaller of said openings limits the rotation of the shaft element 6 such that in each extreme position, the corresponding crossbar 14 hits the control shaft 4 thus preventing the shaft element 6 from rotating any farther.

It is to be noted that the angle between the extreme positions of the shaft element 6 is substantially smaller than the opening between the crossbars 14. This results from the radial dimension of the control shaft 4. The swing angle of the shaft element 6 is dimensioned in a manner allowing the controllable poles of the switching device to be shifted reliably from one position to another. In the embodiment shown in the figures, the thickness of the control shaft 4 is dimensioned such that the angle between the extreme positions of the shaft element 6 is about 35°. An about 90° rotational angle of the control shaft 4 corresponds to the extreme positions of the shaft element 6.

In the control device module according to the above-described embodiment, the control shaft 4 is adapted to limit the rotation of the shaft element 6, and the shaft element 6 is adapted to limit the rotation of the control shaft 4, and therefore no separate limiter means for limiting the rotational angle of the control shaft 4 or the shaft element 6 are required. The fact that no separate limiter means are required simplifies the structure of the control device module and saves space inside the frame part 2. The frame part 2 of a control device module of the above-described type can be made from a softer material than the control shaft 4 and the shaft element 6, since the frame part 2 does not have to serve as a rotation limiter.

The control shaft 4 of a switching device according to a preferred embodiment of the invention is a pipe shaft, i.e. it is hollow inside. A hole substantially of the shape of e.g. a square can be provided through the control shaft 4 in the axial direction, such a hole being provided in the control shaft 4 shown in the figures.

A control shaft 4 of the pipe shaft type can be turned with an inner shaft (not shown) insertable into the control shaft 4. The distance of an actuator, such as an operating handle, from the frame part 2 of the control device can be easily adjusted by gliding the inner shaft in the axial direction relative to the control shaft 4.

When two control device modules provided with a tubular control shaft 4 are placed coaxially relative to the control shafts 4, the control shaft 4 of both control device modules can be turned with one sufficiently long inner shaft, which is inserted into the control shaft 4 of both modules. In this case, at least one of said two modules has to be such that its control shaft 4 can be accessed from both its axial ends.

Placing two control device modules provided with a tubular control shaft 4 back to back allows a control device for a throw-over switch, for example, to be provided. Such a control device can be of the type I-0-II, in which case the turning of the control shaft from the zero position in a first direction closes the first poles, and the turning of the control shaft from the zero position in a second direction closes the second poles.

In case control device modules, each comprising a shaft element 6 of FIG. 3*a* and a control shaft 4 of FIG. 3*b*, are employed in a throw-over switch of the type I-0-II described above, one shoulder 18 has to be removed from the shaft element 6 of both modules. The shoulder to be removed is the one allowing the control shaft to turn only 45° anticlockwise relative to the basic position of the control shaft. In this case, the control shaft 4 is able to turn 90° anticlockwise relative to the basic position of the control shaft, whereby the control shaft of the control device module coupled back to back with said module reaches its I position. In such a throw-over switch, the turning of the interconnected control shafts 4 in the first direction is limited by the remaining shoulder of the first module, and the turning in the second direction is limited by the remaining shoulder of the second module.

Alternatively, the control shafts of two adjacent control device modules can also be interconnected by means of connecting elements provided at the ends of said control shafts.

In a switching device according to the above-described embodiment, the control shaft 4 passes through the working shaft 3. It is also feasible to provide a switching device according to the invention, where the working shaft passes through the control shaft.

The structure of the invention wherein one shaft of the switching device passes through another shaft was described above in connection with a modular switching device. However, it is evident that, if desired, the structure of the invention can also be used in a switching device wherein the control equipment is placed in the same frame part as the poles of the switch.

It is obvious to a person skilled in the art that the basic idea of the invention can be implemented in a variety of ways. Consequently, the invention and its embodiments are not restricted to the above examples, but may vary within the scope of the claims.

The invention claimed is:

1. A switching device comprising a working shaft and a control shaft installed in a frame part, the control shaft being rotatable and adapted to turn the working shaft, and the working shaft being adapted to change the position of poles of the switching device, wherein one of said two shafts passes through the other, and wherein said shafts are at an angle relative to one another.

2. A switching device as claimed in claim 1, wherein the control shaft passes through the working shaft.

3. A switching device as claimed in claim 2, wherein the axes of rotation of the working shaft and the control shaft intercept.

4. A switching device as claimed in claim 3, wherein the working shaft and the control shaft are shaped in such a manner that they limit each other's rotational angles to desired values.

5. A switching device as claimed in claim 4, wherein the control shaft is rotatable from either axial end.

6. A switching device as claimed in claim 1, wherein the axes of rotation of the working shaft and the control shaft intercept.

7. A switching device as claimed in claim 6, wherein the angle at which the axes of rotation of the working shaft and the control shaft intercept is substantially 90°.

8. A switching device as claimed in claim 1, wherein the working shaft and the control shaft are shaped in such a manner that they limit each other's rotational angles to desired values.

9. A switching device as claimed in claim 1, wherein the control shaft is rotatable from either axial end.

10. A switching device as claimed in claim 9, wherein its control shaft is adapted to be connected to a control shaft of another similar type of switching device in a manner allowing the working shafts of both switching device to be turned by rotating the control shaft of one or the other switching device.

11. A switching device as claimed in claim 10, wherein control shaft is a pipe shaft, and wherein the control shaft is adapted to be connected to a control shaft of another similar type of switching device by means of an inner shaft insertable into the control shafts.

* * * * *